United States Patent [19]

Detjen

[11] 4,250,937

[45] Feb. 17, 1981

[54] SAWMILL LOG HANDLING METHOD

[75] Inventor: Robert K. Detjen, Eau Claire, Wis.

[73] Assignee: McDonough Manufacturing Company, Eau Claire, Wis.

[21] Appl. No.: 2,921

[22] Filed: Jan. 11, 1979

Related U.S. Application Data

[60] Division of Ser. No. 805,553, Jun. 10, 1977, Pat. No. 4,152,960, and a continuation-in-part of Ser. No. 772,152, Feb. 25, 1977, Pat. No. 4,146,072, which is a continuation-in-part of Ser. No. 556,836, Mar. 10, 1975, Pat. No. 4,009,632.

[51] Int. Cl.[3] ..... B27B 1/00; B27B 7/00

[52] U.S. Cl. ..... 144/312; 83/731; 83/435.1; 144/39; 144/326 R

[58] Field of Search ..... 83/731, 435.1; 144/312, 144/39, 242 R, 242 D, 326 R

[56] References Cited

U.S. PATENT DOCUMENTS

| | | | |
|---|---|---|---|
| 3,180,377 | 4/1965 | Pinder | 83/731 |
| 3,731,578 | 5/1973 | Ackerfeldt | 83/731 |
| 3,960,041 | 6/1976 | Warren et al. | 144/39 |
| 4,100,956 | 7/1978 | Stearns | 83/435.1 |

*Primary Examiner*—Donald R. Schran

*Attorney, Agent, or Firm*—Beveridge, DeGrandi, Kline & Lunsford

[57] ABSTRACT

A log is moved forwardly in a longitudinal path through a saw while engaged between a pusher dog and a holdback dog. The dogs are supported respectively by a pair of endless carriers which are parallel and adjacent to each other on one side of the log path. The log is scanned and rotationally oriented before being engaged by simultaneous forward movement of the pusher dog and rearward movement of the holdback dog. Forward movement carries the log first to a chipper head and then to a guide surface which engages the face cut by the chipper head for stabilizing the log during sawing.

6 Claims, 4 Drawing Figures

SAWMILL LOG HANDLING METHOD

REFERENCE TO RELATED APPLICATIONS

This is a division of application Ser. No. 805,553, Filed June 10, 1977 U.S. Pat. No. 4,152,960, which is relied upon and the entire disclosure and specification of which is hereby incorporated by reference, which is a continuation-in-part of application Ser. No. 772,152 filed Feb. 25, 1977, now U.S. Pat. No. 4,146,072, which is a continuation-in-part of my earlier application Ser. No. 556,836 filed Mar. 10, 1975, now U.S. Pat. No. 4,009,632. The entirety of said earlier applications is incorporated hereby by reference.

BACKGROUND AND SUMMARY OF THE INVENTION

This invention relates to improvements in sawmill apparatus, pertaining to the means for engaging logs and advancing them longitudinally through the saw blades.

As in my earlier applications referred to above, the present invention pertains to apparatus having a first endless carrier supporting a driven pusher dog for engaging the rear end of a log, and a second endless carrier supporting a retarded holdback dog for engaging the forward end of a log. In the present instance, however, both carriers are located on a same side of the log. When used in conjunction with circular saws, the dogs themselves project into the space between the saw blades, but the width-consuming dog-supporting elements are located outside the space between the saw blades, making it possible to move the blades closer together to provide a narrower heart cant than in my earlier apparatus. Further, the present apparatus adapts itself particularly well to use in conjunction with scanning apparatus and with a chipper head for forming a guide surface on the bottom face of a log.

BRIEF DESCRIPTION OF THE PREFERRED EMBODIMENTS

Figure 1:
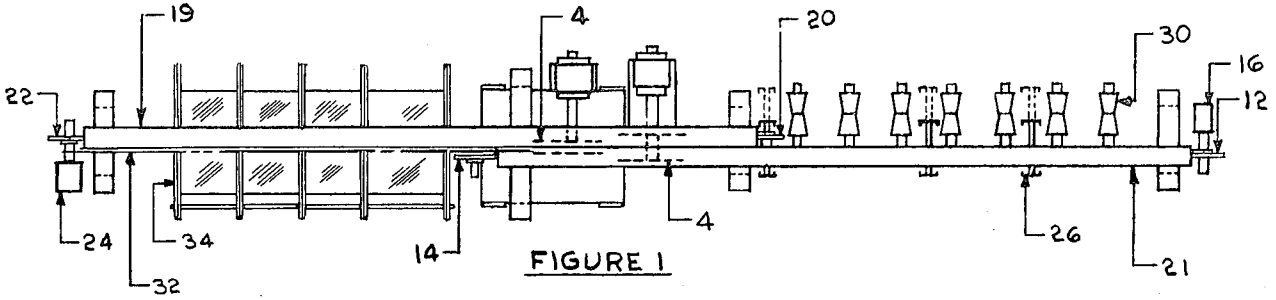
FIG. 1 is a schematic plan view of a sawmill apparatus constructed according to the invention.
Figure 2:
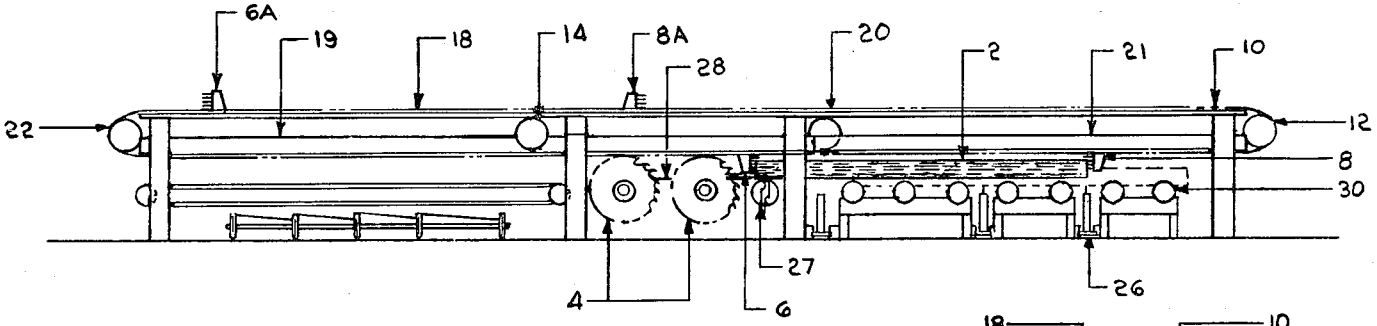
FIG. 2 is a side elevational view of the apparatus of FIG. 1.

FIGS. 1 and 2 show a log 2 supported on the apparatus for movement through the circular saw blades 4 which are rotated about transverse axes located below the log. The log is retained at its forward end by a holdback dog 6, and at its rear end by a pusher dog 8.

The pusher dog 8 is connected to a chain 10, the opposite ends of which are supported on a pair of sprockets 12 and 14. The chain is appropriately guided between the sprockets 12 and 14 in any suitable manner, and the sprocket 12 is driven by a drive motor 16 to advance the chain 10 and dog 8 in a forward direction toward the saw blades 4. Holdback dog 6 is carried by an endless chain 18, the rear portion of which passes over a sprocket 20. Its forward end engages a sprocket

22 driven by a reversible hydraulic motor 24. Preferably, all sprockets 12, 14, 20 and 22 are of the same diameter and their axes of rotation are in a common plane. For ease in understanding the drawings, the sprockets are shown of different sizes in FIG. 2.

Figure 3B:
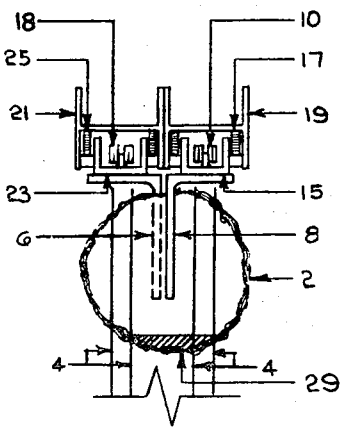
FIG. 3B is an enlarged forward-looking end view showing details of the log-engaging dogs and their supports.
Figure 3A:
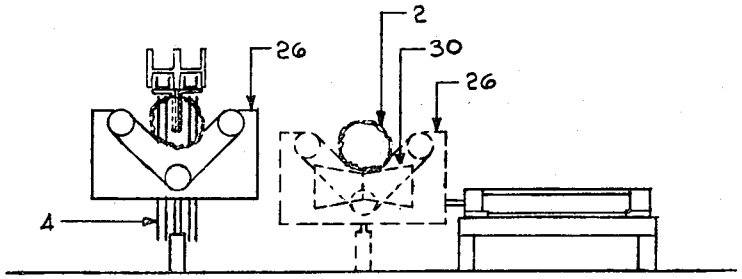
FIG. 3A is a forward-looking end view of portions of the apparatus, showing also a mechanism for delivering logs to the apparatus, two positions of this mechanism being shown respectively in broken and solid lines.

While being cut by the blades 4, the log 2 moves along a path directly beneath the chains 10 and 18, the forward and rearward ends of the log being engaged respectively by the dogs 6 and 8. Each dog assembly preferably includes a roller-supported carriage connected to the chain and provided with a dog which is located downwardly and laterally inwardly of its respective chain, the dogs moving along paths between the saw blades and the carriages moving along paths displaced from the space between the saw blades. As shown in FIG. 3B, the pusher dog 8 is supported on carriage 15 which has rollers 17 riding on a track within an I-beam rail 19. While moving along its working path and engaging the trailing end of a log, the pusher dog 8 is located downwardly and inwardly of its drive chain 10.

The holdback dog 6 is supported on a track in I-beam rail 21 by a carriage 23 provided with rollers 25. As shown in FIG. 3B, the holdback dog 6 is positioned downwardly and inwardly of its drive chain 18, at a minimum distance from the path of pusher dog 8. The space-consuming dog-supporting and driving means move along paths displaced from the space between the saw blades, making it possible to provide a relatively narrow heart cant if desired.

Prior to being engaged by the dogs 6 and 8, the log is supported on a set of V-blocks 26 located at the position shown in solid lines in FIG. 3B. Simultaneously, the motor 16 drives the dog 8 forwardly and the motor 24 drives the dog 6 rearwardly so that spurs in the dogs engage the opposite ends of the log for firm retention thereof. The motor 24 is then deactivated and the flow of hydraulic fluid therethrough is restricted but not stopped so that the motor 24 will resist movement of the chain 18 and therefore cause the dog 6 to deliver a retarding force to the forward end of the log 2. The motor 16 continues to operate to drive the pusher dog 8 forwardly against the resistive force of the holdback dog 6, advancing the log along its path toward the saw blades 4.

A chipper head 27 is located in the path of the advancing log, set to remove only about one quarter inch from the bottom face of the log and provide a flat planed surface thereunder. The portion to be removed is designated 29 in FIG. 3B. This planar surface is directly aligned with the skid plane 28 which remains in contact with the log throughout the sawing operation. The skid plate 28 tends to stabilize the log and prevent it from being moved with respect to the dogs 6 and 8 during the time the log 2 is being sawed by the circular blades 4.

After the log has completed its movement through the saw blades 4, the sawn pieces thereof are removed by any conventional machinery such as the heart cant discharge chain 32 and the slab and side board discharge chains 34. At this time, the motor 24 is activated in a forward direction to advance a second holdback dog **6*a*** to a position immediately forward of the position to be occupied by the next log engaged thereby.

Preferably, a second pusher dog **8*a* is located on the chain 10 and an additional holdback dog 6*a* is located on the chain 18, these dogs being spaced one half the chain length from their respective dogs 6 and 8** to reduce the extent of chain movement required to return the apparatus to its initial or starting position.

One procedure for handling the incoming logs involves a set of hourglass rolls 30, and a set of elevatable and translatable V-blocks 26. The log 2 is initially placed on the hourglass rolls 30 and then advanced longitudinally approximately three feet past the scanners which are known in the art for the purpose of ascertaining the optimum log orientation for lumber utilization. After the log is scanned, it is rotated to the optimum orientation. Hydraulic cylinders then raise the V-blocks 26, elevating the log 2 to the position shown in dot-dash lines in FIG. 3B. Then the V-blocks 26 are translated by another hydraulic motor to the loading station in the central longitudinal plane of the apparatus i.e. to the position shown in solid lines in FIG. 3B. Then, as previously explained, the holdback dog 6 is moved rearwardly so its spurs engage the forward end of the log, the pusher dog 8 is moved forwardly so that its spurs engage the rearward end of the log, and then the log is advanced past the chipper head 27 and through the saw blades 4.

As the invention may assume many forms other than the disclosed preferred embodiment, it is emphasized that the invention is not limited to the disclosed embodiment but is encompassing of innumerable variations thereof within the spirit of the following claims.

I claim:

1. A sawmill log handling method for advancing logs along a machine axis from an infeed side of a saw, through the saw and to an outfeed side of the saw, said method comprising the steps of, positioning the log with its longitudinal axis substantially parallel to said machine axis, engaging a forward end of a log with a forward holdback dog by moving the holdback dog rearwardly against the forward end of the log, driving the log forwardly after the holdback dog is engaged therewith by imposing a forward driving force on a pusher dog engaged with the rear end of the log along said machine axis, imposing a rearward retarding force on the holdback dog during its forward movement to clamp the log between the pusher dog and the holdback dog, sawing the log as it is engaged by both dogs and moved forwardly along the machine axis.

2. The method of claim 1 including the step of chipping the log with a chipper head to provide a planar surface thereon as the log is engaged by both dogs and advanced along the machine axis.

3. The method of claim 1 wherein said positioning of the log includes the step of rotating the log to its optimum orientation for lumber utilization.

4. A sawmill log handling method for advancing logs along a machine axis from an infeed side of a circular saw, through the saw and to the outfeed side of the saw, said method comprising the steps of, rotating the saw about an axis which is spaced from and lies substantially perpendicular to said machine axis, engaging the log between a forward holdback dog supported on a first carrier and a rear pusher dog supported on a second carrier, said carriers being unconnected to each other and being located on an opposite side of the machine axis from said saw axis, moving the log forwardly by imposing a forward driving force on said rear pusher dog while imposing a rearward retarding force on the forward holdback dog to clamp the log between said dogs, said dogs during such movement being connected to their respective carriers and moving through an area which is displaced radially from the saw axis and displaced axially from the saw and, sawing the log during said movement.

5. The method of claim 4 including the step of chipping the log with a chipper head to provide a planar surface thereon as the log is engaged by both dogs and advanced along the machine axis.

6. The method of claim 4 wherein said positioning of the log includes the step of rotating the log to its optimum orientation for lumber utilization.

* * * * *